US006146432A

United States Patent [19]

Ochs et al.

[11] Patent Number: 6,146,432

[45] Date of Patent: Nov. 14, 2000

[54] PRESSURE GRADIENT PASSIVATION OF CARBONACEOUS MATERIAL NORMALLY SUSCEPTIBLE TO SPONTANEOUS COMBUSTION

[75] Inventors: Thomas L. Ochs, Albany, Oreg.; William D. Sands, Butler; Karl Schroeder, Pittsburgh, both of Pa.; Cathy A. Summers, Albany, Oreg.; Bruce R. Utz, Pittsburgh, Pa.

[73] Assignee: The United States of America as represented by the Department of Energy, Washington, D.C.

[21] Appl. No.: 09/354,051

[22] Filed: Jul. 15, 1999

[51] Int. Cl.[7] ..... C10L 5/00

[52] U.S. Cl. ..... 44/501; 44/607; 44/608; 44/620; 44/628

[58] Field of Search ..... 44/501, 620, 628, 44/607, 608

[56] References Cited

U.S. PATENT DOCUMENTS

| | | | |
|---|---|---|---|
| 4,249,909 | 2/1981 | Comolli | 44/620 |
| 4,328,002 | 5/1982 | Bender | 201/17 |
| 4,778,482 | 10/1988 | Bixel et al. | 44/501 |
| 4,783,199 | 11/1988 | Bixel et al. | 44/501 |
| 4,828,576 | 5/1989 | Bixel et al. | 44/501 |
| 5,601,692 | 2/1997 | Rinker et al. | 44/626 |
| 5,711,769 | 1/1998 | Rinker et al. | 44/620 |
| 5,863,304 | 1/1999 | Vrall et al. | 44/626 |

*Primary Examiner*—Jacqueline V. Howard
*Attorney, Agent, or Firm*—Mark F. LaMarre; Mark P. Dvorscak; William R. Moser

[57] ABSTRACT

This invention is a process for the passivation or deactivation with respect to oxygen of a carbonaceous material by the exposure of the carbonaceous material to an oxygenated gas in which the oxygenated gas pressure is increased from a first pressure to a second pressure and then the pressure is changed to a third pressure. Preferably a cyclic process which comprises exposing the carbonaceous material to the gas at low pressure and increasing the pressure to a second higher pressure and then returning the pressure to a lower pressure is used. The cycle is repeated at least twice wherein the higher pressure may be increased after a selected number of cycles.

19 Claims, 6 Drawing Sheets

PRESSURE GRADIENT PASSIVATION OF CARBONACEOUS MATERIAL NORMALLY SUSCEPTIBLE TO SPONTANEOUS COMBUSTION

STATEMENT REGARDING FEDERALLY SPONSORED RESEARCH OR DEVELOPMENT

The United States Government has rights in this invention pursuant to the employer-employee relationship of the U.S. Department of Energy and the inventor.

BACKGROUND OF THE INVENTION

1. Field of the Invention

The present invention relates to coal processing and handling. More particularly, this invention relates to deactivation or passivation of coal or solid carbonaceous fuels to reduce the tendency of the material to spontaneously combust.

2. Description of Related Art

Solid carbonaceous materials, in particular solid carbon-based fuels, may autoignite or spontaneously combust under the proper conditions. Carbonaceous material may include coal, low-rank coal, dried coal, peat, char, or other porous solid fuel. For example, certain coals, such as sub-bituminous, lignite and brown coal, subsequent to mining can spontaneously combust due to chemical reactions between the coal, moisture and oxygen present in the air. This reaction can occur due to water combining with other components in the coal to generate a sufficient amount of heat to raise the temperature of the coal to the ignition point. Further, materials present in the coal may oxidize upon exposure to air, which in turn generates a sufficient amount of heat for the coal to reach ignition temperature. The components being oxidized within the coal may be non-carbonaceous matter or unsaturated carbon compounds within the coal. Certain coals, which are normally stable with respect to autoignition after mining, may be brought into proper conditions for autoignition after subsequent processing. For example, many low-rank coals contain significant amounts of free moisture. After drying to remove excess moisture these coals present a significant autoignition hazard.

Low-rank coals, such as sub-bituminous coal or lignite may contain more than about 10% moisture and typically 15–50 weight percent moisture. Some low-rank coals may contain as much as 60 weight percent moisture. Such wet low-rank coals cannot be shipped economically over great distances due to the cost of transporting a significant fraction of unusable material in the form of water. Further, these low-rank coals cannot be burned efficiently due to the energy required to vaporize the water. Due to the lowered heating value and high cost of shipping unusable material, it is advantageous to remove all or part of the water from the low-rank coals prior to shipment and/or storage. However, drying such fuels usually leads to activation of the low-rank coals or chars. The reactive coals or chars may be hazardous due to the potential for damage to property or life due to the reaction of the coal or char with atmospheric oxygen and moisture and consequential heating of the coal, which makes it subject to spontaneous ignition during either shipment or storage.

Indicators of the propensity of coals or chars to spontaneously combust include the uptake of oxygen as measured in terms of torr of oxygen per gram of material. Methods for testing this indicator are listed in U.S. Bureau of Mines "Report of Investigation 9330" by Miron, Smith, and Lazzara. The terms "oxygen uptake" and "oxygen demand" refer to the test methods of the "Report of Investigation 9330" or related test methods when used in this document.

In the past, wet low-rank coals such as those from the western United States have been dried by methods such as, but not limited to, thermal drying using process heat, waste heat, microwaves, pressurized water, steam, hot oil, molten metals, and other supplies of high temperatures. The heated coals release the free moisture trapped in the pores, water molecules associated with hydrated molecules or associated in other ways with the coal, producing dried coals or chars. Other methods of drying may include mechanical drying (such as centrifugal separation), the use of dry gases, or the use of desiccants or absorbents. Once dried, coals or chars can become more active and are known to spontaneously combust.

One approach to reduce the potential for the spontaneous combustion of the carbonaceous material, such as dried low-rank active coal or char (those susceptible to spontaneous combustion), is to seal the exterior surface of the char by using oils, polymers, waxes or other materials to coat the surface of the coal. Examples of such coating processes are U.S. Patent Numbers 3,985,516 and 3,985,517 to Johnson, which disclose heating and intimate mixing of coal with heavy oils to coat the particles. Such coating procedures are rather effective in preventing reabsorption of moisture by the char, however, such coatings are expensive due to the cost of the hydrocarbon materials added and thus are unattractive. It would be advantageous to dry wet coals and process them in such a manner that the dried coal or char particles are made less reactive after moisture removal, so as to prevent the reaction of the carbonaceous material with oxygen without the need for externally supplied coating materials. An alternate method to reduce spontaneous combustion is the prolonged exposure of the coal to air. Another method includes the use of oxidizing agents sprayed on coal.

Another method to treat the carbonaceous material is the use of high-temperature water under pressure. The coatings perform their work by covering the pores and limiting the access of active components of the air to active sites in the material (dried coal in this instance). U.S. Pat. No. 1,632,829 to Fleissner discloses a process for drying wet coal by steam heating it using a procedure wherein steam provided above the coal is maintained at high partial pressure such that moisture will not escape during coal heat up, then reducing the steam pressure to permit the escape of moisture and rapid drying of the coal. Also, U.S. Patent Number 4,052,169 to Koppelman discloses a process for upgrading lignitic coal, comprising heating it in an autoclave at about 750° F. temperature and 1000 psig or more pressure to effect thermal restructuring, followed by cooling and depositing condensible organic material on the lignite to provide a stabilization of the upgraded product and render it non-hygroscopic and more resistant to weathering and oxidation during shipment and storage. The use of high temperature water is reported to drive off carboxylic acid groups and thereby remove those sites from future activity with the active components of the fluid.

BRIEF SUMMARY OF THE INVENTION

An object of this invention is to provide a process to reduce the ability of carbonaceous material such as low-rank coal, dried coal, char or peat to spontaneously combust thereby rendering such carbonaceous materials amenable to normal transport and handling procedures.

Another object of this invention is to provide a means for stabilizing low-rank coals to improve the safety and economics for using such coals.

These and other objectives of the invention, which will become apparent from the following description, have been achieved by a novel process for deactivation of a porous carbonaceous material by; providing an oxygenated gas; increasing the pressure on the carbonaceous material with the oxygenated gas from a first pressure to a second pressure; and reducing the pressure to a third pressure, wherein the third pressure is less than the second pressure.

The increase in pressure of the oxygenated gas on the carbonaceous material can be achieved through a number of process routes, such as, the continuous steady increases of pressure to a peak pressure, increasing pressure in steps wherein the pressure is maintained and then momentarily reduced prior to further increases, or step-wise increases in pressure wherein the pressure is held constant for a period of time before increasing to the next constant pressure step.

Preferably, the process for the deactivation of a porous carbonaceous material is achieved by; first, providing an oxygenated fluid; then exposing the carbonaceous material to the oxygenated fluid at a second pressure for a period of time sufficient to oxygenate the porous carbonaceous material; reducing the pressure of the oxygenated gas to a third pressure wherein the third pressure is less than the second pressure.

The process may include additional steps of: exposing the carbonaceous material to the oxygenated gas at a fourth pressure for a period of time sufficient to further oxygenate the porous carbonaceous material and then reducing the pressure of the oxygenated gas to a fifth pressure wherein the fifth pressure is less than the fourth pressure.

Alternatively, the process for deactivation of a porous carbonaceous material may comprise exposing the porous carbonaceous material to an oxygenated gas at a first pressure; providing an oxygenated gas; increasing the pressure of the oxygenated gas on the porous carbonaceous material to a second pressure; maintaining the pressure on the porous carbonaceous material for a period of time at the second pressure; increasing the pressure of the oxygenated gas to a third pressure wherein the third pressure is greater than the second pressure; and reducing the pressure of the oxygenated gas to a final pressure. The process may further comprise increasing the pressure of the oxygenated gas from the third pressure to a fourth pressure; maintaining the pressure on the porous carbonaceous material at the fourth pressure for a period of time prior to reducing the pressure of the oxygenated gas. The process may also comprise increasing the pressure of the oxygenated gas from the first pressure to a maximum pressure in a greater number of steps than described here.

The process may take place at a temperature from about −25° C. to about 750° C. Preferably, the process takes place at a temperature from about 15° C. to about 100° C. The first pressure may be less than atmospheric pressure to about atmospheric pressure. The second pressure may range from about atmospheric pressure to about 1500 psig. Preferably, the second pressure is 500 psig. The third pressure may range from about atmospheric pressure to less than about 1000 psig. Preferably, the third pressure is atmospheric pressure. The fourth pressure may vary from about atmospheric pressure to about 1500 psig. Preferably the fourth pressure is from about atmospheric pressure to about 1000 psig. The fifth pressure may vary from about atmospheric pressure to less than about 1500 psig. The second, third, fourth, and fifth pressure may vary from about atmospheric to less than about 2000 psig. Where additional pressure cycles or steps are needed these pressures may be up to a maximum of about 2000 psig.

Carbonaceous material may include, but is not limited to coal, low-rank coal, dried coal, peat, char, or other porous solid fuel. Preferably, the carbonaceous material is subbituminous coal or lignitic coal or char. The carbonaceous material may contain from about 0.1 weight percent to about 20 weight percent of moisture. Preferably, the carbonaceous material may contain from about 1 weight percent to about 20 weight percent of moisture.

The oxygenated gas contains from about 1 volume percent to about 35 volume percent oxygen. Preferably, the oxygenated gas contains from 10 to 25 volume percent oxygen. Preferably, the oxygenated gas is air.

BRIEF DESCRIPTION OF THE SEVERAL VIEWS OF DRAWINGS

With this description of the invention, a detailed description follows with reference being made to the accompanying figures of drawings which form part of the specification, in which like parts are designated by the same reference numbers, and of which:

The invention is not limited in its application to the details and construction and arrangement of parts illustrated in the accompanying drawings since the invention is capable of other embodiments that are being practiced or carried out in various ways. Also, the phraseology and terminology employed herein are for the purpose of description and not of limitation.

DETAILED DESCRIPTION OF THE INVENTION

Description of the Preferred Embodiment(s)

Figure 1:
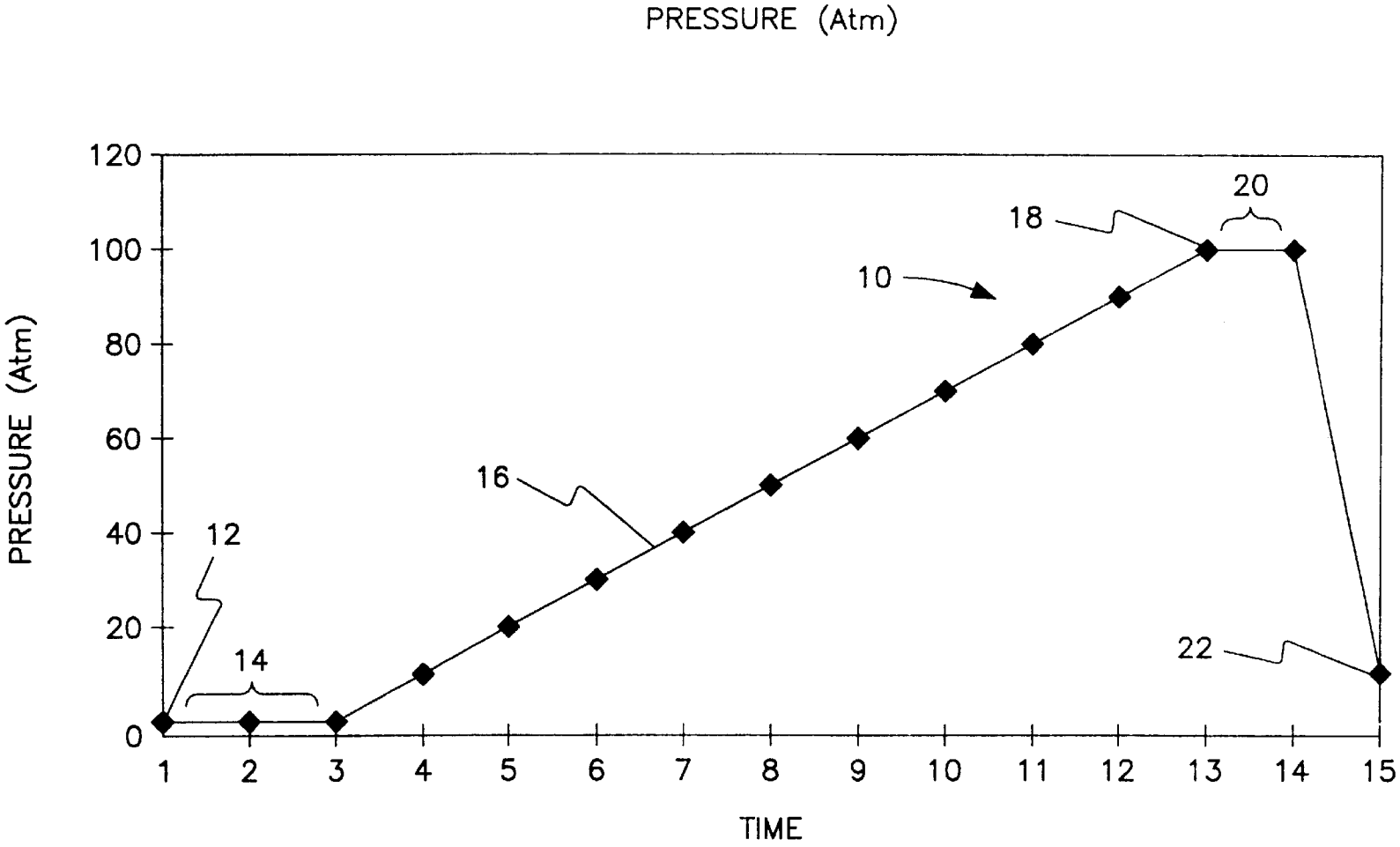
FIG. 1 is a graphical presentation of the pressure verses time relationship for a continuous pressure ramp-up version of the process of the invention.

As shown in FIG. 1, a hypothetical example of the process of the invention is shown generally in graphical form at 10. Generally the process of this invention is the deactivation of a porous carbonaceous material with respect to spontaneous combustion by exposing the carbonaceous material to an oxygenated gas at increasing pressures. The carbonaceous material passivated/deactivated is permitted to stabilize at a first pressure 12 for a period of time 14. The pressure on the carbonaceous material is increased 16 with an oxygenated gas to a second pressure 18. The actual rate of increase to the second pressure 18 is dependent on the actual process used and the material being treated. Reaction between oxygen and the carbonaceous material, takes place while the pressure is ramped up. The pressure is maintained at the second pressure for a period of time 20 sufficient to permit further reaction between the carbonaceous material and the oxygenated gas. The time for which the material is maintained at the second pressure should also be sufficient for the oxygenated gas to react within the interstices of the material. The pressure on the material is then reduced to a third pressure 22 that is less than the second pressure 18.

Preferably, the present invention is used to passivate dried low-rank coal (hereinafter DLRC) or char, however, other carbonaceous materials as discussed hereinabove can be used with the process of this invention. DLRC can be produced from any number of processes such as; U.S. Pat. No. 5,601,692—Tek-Kol process, Char forming and atmospheric pressure air for passivation; U.S. Pat. No. 5,547,549—Vibrating bed pyrolysis system; U.S. Pat. No. 5,503,646—drying coal and mixing it with heavy oil to improve both; U.S. Pat. No. 5,322,530—WRI process: Fluidized bed, char forming and pitch-like coating for passivation (from the process EnCoal); U.S. Pat. No. 4,800,015—drying coal in hot oil to form a stable dried coal with an oil coating; U.S. Pat. No. 4,769,042—fluidized bed drying and then cooling with water then treating with steam at ambient pressure; U.S. Pat. No. 4,750,913—drying and mixing with wet coal; and U.S. Pat. No. 4,645,513—drying and then oxidation with air at ambient pressure.

Figure 2:
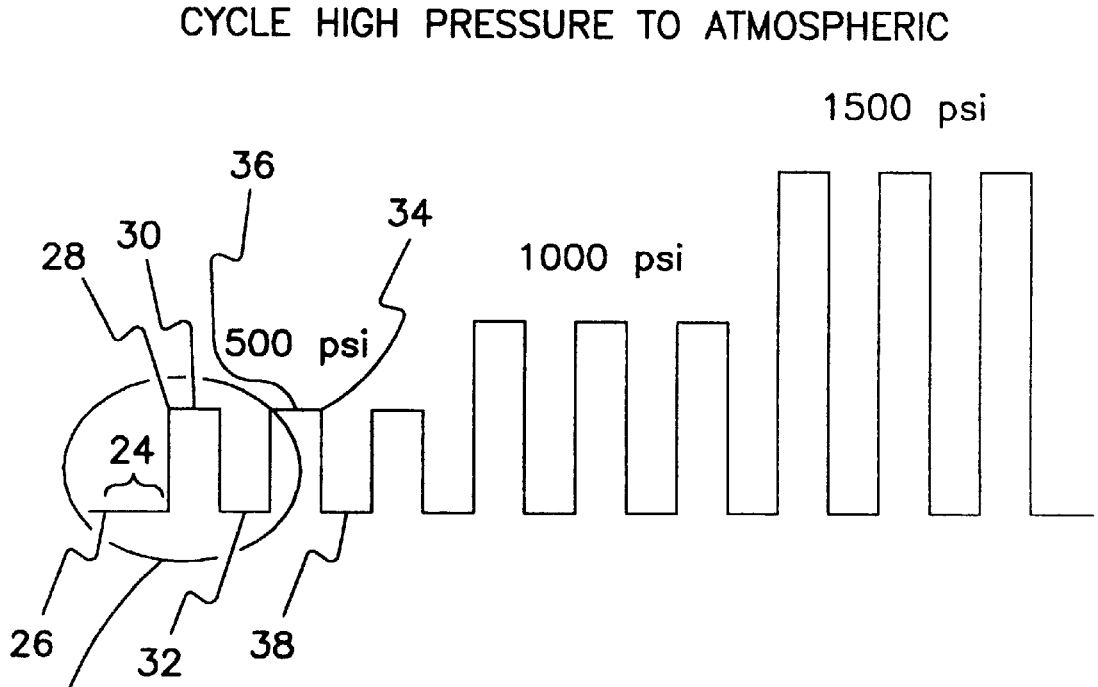
FIG. 2 is a graphical presentation of the pressure verses time relationship for a cyclic pressure ramp-up version of the process of the invention.
Figure 2A:
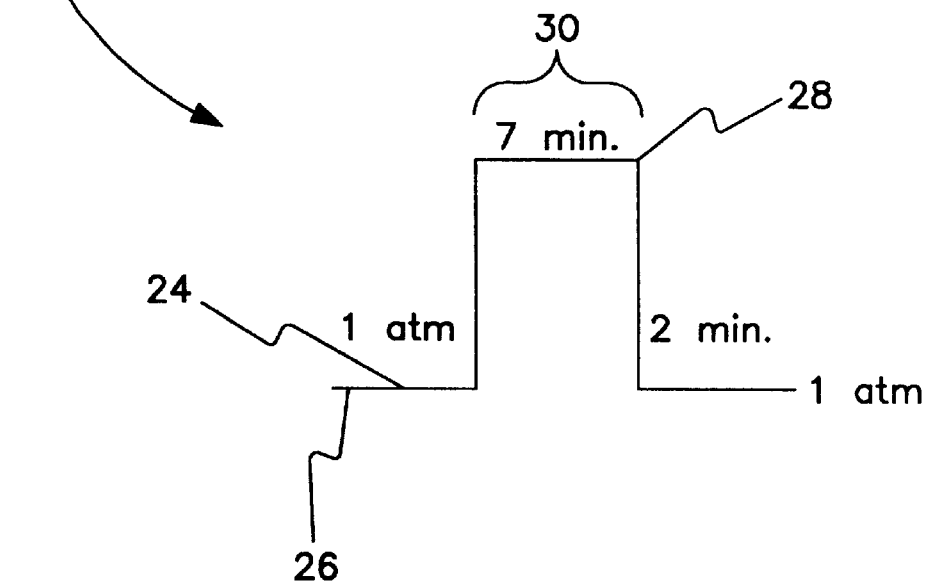
FIG. 2*a* is a detail from FIG. 2.

The DLRC is placed in an appropriate pressure vessel, such as an autoclave. The DLRC may be agitated by appropriate means such as stirring blades or paddles, however, such agitation means are not required to accomplish the objectives of this process. The preferred process steps are illustrated in FIG. 2 and 2*a*. The DLRC is permitted to stabilize for some period of time 24 at a first pressure 26. The stabilization period for the experimental tests was on the order of two to ten minutes. Industrial scale process may require a longer stabilization period. The first pressure may be a moderate vacuum or a pressure about atmospheric pressure. Low pressure on the order of one to two atmospheres may be used when process parameters so indicate. Also, the initial stabilization period may be done with an oxygen-free or low oxygen gas. Alternatively an inert gas such as nitrogen or argon may be used. The DLRC is then exposed to an oxygenated gas and the pressure is raised to a second pressure 28. The DLRC is maintained at the second pressure 28 for a period of time 30 sufficient for the carbonaceous material to stabilize. The pressure on the system and the DLRC is then reduced to a third pressure 32 that is less than the second pressure. This cycle may be repeated as many times as needed to passivate the DLRC. For example the DLRC may be pressurized in the passivation gas to a fourth pressure 34 and maintained at the fourth pressure until the DLRC has stabilized 36, wherein the fourth pressure may be greater than the second pressure. The system including the DLRC is then reduced to a fifth pressure 38 which is less than the fourth pressure 34.

Figure 3:
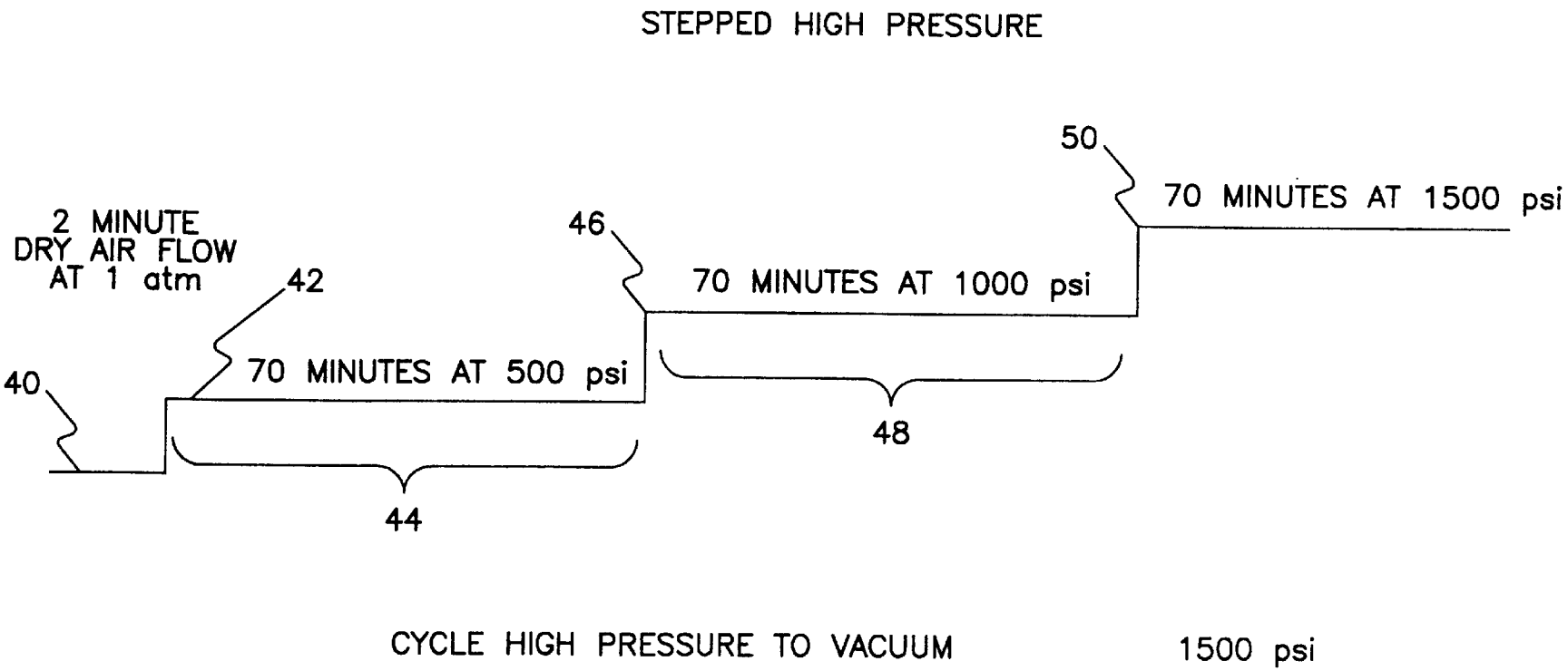
FIG. 3 is a graphical presentation of the pressure verses time relationship for a continuous step-wise pressure ramp-up version of the process of the invention.

A third possible embodiment is to increase the pressure of the oxygenated gas stepwise without decreasing the pressure between cycles as shown in FIG. 3. In this embodiment of the invention the carbonaceous material is stabilized at a first pressure 40. The pressure of the oxygenated gas is increased to a second pressure 42 and maintained at that pressure for a period of time 44. The pressure is then increased from the second pressure 42 to a third pressure 46 without first reducing the pressure. The pressure may be held at the third pressure 46 for a period of time 48 before increasing the pressure to a fourth pressure 50. The pressure may then be reduced to a lower pressure after being maintained at the fourth pressure 50 for a period of time.

The first pressure is about atmospheric pressure. The second pressure may range from about atmospheric pressure to about 500 psig. The third pressure may range from about atmospheric pressure to less than about 1000 psig. The fourth pressure may vary from about atmospheric pressure to about 1500 psig. Alternatively, more steps may be used with smaller pressure increases at each step. Alternatively, fewer steps may be used with a greater pressure increase at each step. The second, third, fourth, and each additional pressure may vary from approximately atmospheric pressure to approximately 2000 psig.

The oxygenated gas for use with the process of the invention may contain from about 1 volume percent oxygen to about 35 volume percent oxygen. Preferably, the oxygenated gas contains from about 10 volume percent to about 25 volume percent oxygen. An oxygenated gas containing a lower level of oxygen may be used for the first stage of pressurization, then a gas containing a higher level of oxygen may be used in subsequent cycles. For example, a gas containing from about one to about five volume percent oxygen may be used to pressurize the carbonaceous material up to the second pressure. Subsequent pressurization steps may be done with a gas that contains from about five to about 21 volume percent oxygen. The preferred oxygenated gas for use with this invention is air.

EXPERIMENTAL RESULTS

Samples of a sub-bituminous western US coal sized to minus ¼ inch were prepared for the deactivation test by high-temperature dehydration similar to the methods used in commercial dehydration practices such as the SynCoal process. Each sample was approximately 245 grams. Each sample was then packaged under a nitrogen atmosphere in a sealed container for shipment and handling prior to testing. Once ready for testing, to provide a control comparison between test samples, each sample was split into representative test samples of approximately 50 grams by coning and quartering, while still under a relatively inert nitrogen atmosphere, which contained a small fraction of oxygen (approximately 30 ppm–60 ppm oxygen). After splitting, each sample was stored in a tight plastic container in a nitrogen filled glove box (oxygen content less than 60 ppm) until tested. Testing consisted of placing a split sample into an autoclave (while still in the glove box) and then moving the sealed autoclave to the test area for processing. Nitrogen atmosphere is not a part of the process, instead, it prevents reaction of the carbonaceous material with oxygen outside of the processing time for experimental control.

Figure 4:
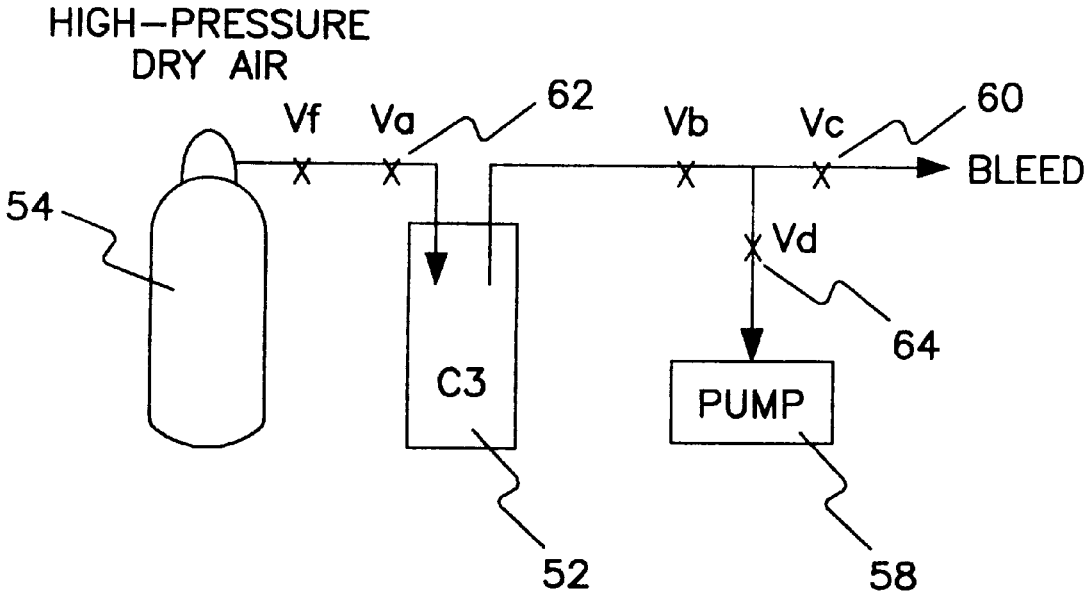
FIG. 4 is a schematic diagram of the dry pressurization apparatus.

As shown in FIG. 4, a standard commercial autoclave 52 similar to those available from commercial vendors was used. The volume of the autoclave used in these experiments was more than was needed for the volume of sample being tested. A rigid plastic sleeve was used in the autoclave as a spacer to reduce the effective volume of the autoclave so that excessive gas was not used during the experiment. The spacer is not integral to the process. Instead it served to reduce the cost of the experiments by reducing the amount of treatment gas used.

Figure 5:
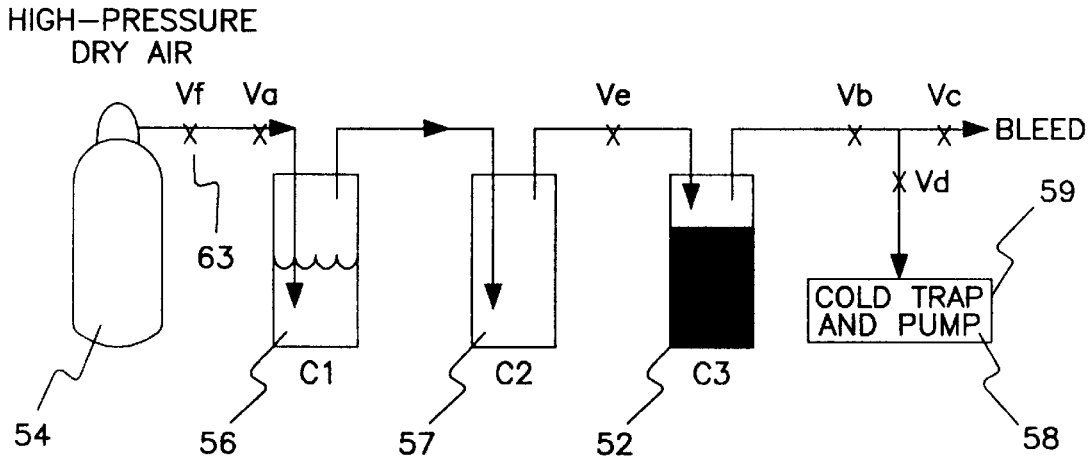
FIG. 5 is a schematic diagram of the wet-gas pressurization apparatus.

The autoclave was then attached to standard cylinders 54 of treating gas such as commercially available compressed dry air or commercially available oxygen/nitrogen mixtures. For those tests in which the treating gas was saturated with water vapor the incoming gas stream was bubbled through water in another autoclave 56, as shown in FIG. 5. A porous baffle material contained within water trap 57 was used to prevent entrainment of water droplets in the gas stream ensuring that only water vapor was carried onto the sample in the gas stream. Other methods for ensuring that water vapor enters the process, may be used.

A commercial vacuum pump 58 was attached to the outgoing gas stream to allow evacuation of the apparatus. In the case of vacuum treatment experiments there was a cold-trap 59 installed in the outgoing gas stream to remove any water vapor before the gas entered the vacuum pump. The cold trap was designed to protect the vacuum pump from the water vapor, and is not necessary to the process.

To pressurize the apparatus, the exhaust valve 60 was closed and an inlet valve 62 connecting the high-pressure cylinders 54 of gas through a standard pressure regulating valve 63 was opened. The regulating valve allowed the gas to flow through until the designated regulating pressure was reached. The pressure was reached quickly (10 seconds to 20 seconds) in this particular apparatus and the sample was allowed to equilibrate at the high-pressure (500 psi, 1,000 psi, or 1,500 psi) for a total of seven minutes. The choice of seven minutes is not meant to indicate an optimal time. Instead, it is a time that was chosen for these particular tests for this particular carbonaceous material and it is expected that this time will vary depending on the material being passivated and the process conditions. As an example, as shown in FIG. 3, for stepped experiments the pressure was increased in increments first to 500 psi and held there for 70 minutes, then to 1,000 psi and held there for 70 minutes, and finally to 1,500 psi and held there for 70 minutes before finally being exhausted. This is an example of a modified process that uses the same principles of pressure differential without cycling. In that case the times are considerably longer at each pressure. The pressures of 500 psi, 1,000 psi, and 1,500 psi are not optimized and were chosen for these experiments only. It is expected that other pressures will be applicable depending on the material being passivated and the process conditions. These pressures were used in these experiments.

For evacuation of the apparatus, the incoming gas valve 62 to the autoclave 52 was shut off to isolate the autoclave from the high-pressure gas. An exhaust valve 60 was opened to exhaust the autoclave 52 to atmospheric pressure. As the autoclave 52 approached atmospheric pressure the exhaust valve 60 was closed, a vacuum pump 58 was started, a (vacuum) pump valve 64 was opened, and a pressure gauge was observed until the pressure in the autoclave 52 reached 5–7 torr absolute. The exhausting and evacuation of this particular experimental apparatus took approximately 15–30 seconds. The vacuum pump continued to operate for a total of 150 seconds after the start of the exhausting of the autoclave. At the end of 150 seconds the vacuum pump valve 64 was closed, the vacuum pump was turned off, and high pressure gas was introduced into the apparatus. The choice of 150 seconds is not considered to indicate an optimal time. Instead, it, is should be considered as a time that was chosen for this particular set of experiments for this particular carbonaceous material and it is expected that this time will vary depending on the material being treated and the process conditions.

For exhaust of the apparatus without evacuation, the inlet gas valve 62 is shut and the exhaust valve 60 is then opened, allowing the high-pressure to bleed off into the atmosphere. This exhaust process takes from 10 seconds to 30 seconds for this apparatus.

For cycling experiments without vacuum, the autoclave 52 with the sample in it was started at atmospheric pressure and the treatment gas was allowed to flow through the autoclave to remove the nitrogen atmosphere that the autoclave initially has from the glove box. The autoclave was then pressurized in accordance with the procedure above. The length of these pressure cycles was set at 7 minutes for these experiments. At the end of the 7 minutes the autoclave was exhausted in accordance with the procedure above and for these experiments stabilized at atmospheric pressure for a total of 2 minutes. This procedure was repeated for the number of cycles designated for each sample at each of the designated high pressure levels.

For cycling experiments with vacuum, the autoclave with the sample in it was started at atmospheric pressure and the treatment gas was allowed to flow through the autoclave to remove the nitrogen atmosphere that the autoclave initially has from the glove box. The autoclave was then pressurized in accordance with the procedure above. The length of these pressure cycles was set at 7 minutes for these experiments. At the end of the 7 minutes the autoclave was evacuated in accordance with the procedure above and for these experiments stabilized at low pressure for a total of 150 seconds. This procedure was repeated for the number of cycles designated for each sample at each of the designated high pressure levels. At the end of the cycles the autoclave was again evacuated prior to moving the sample back to the glove box.

The following tables present the test results for each of the different test runs. A synopsis of each experiment follows the Tables. Samples labeled "none" under the Graphing Category were not used in the statistical analysis of the different process embodiments. All other data (except where indicated) were used for statistical analysis and the preparation of FIG. 6.

TABLE I

| Split | | Residual Oxygen Demand Average (torr/g, 2500 minutes) | | Change (% of pre-test | Graphing |
|---|---|---|---|---|---|
| Number | Treatment | Pre-test | Post-test | value) | Category |
| ME3681-5 | Glove box | 28.2 | 27.0 | 4.26 | A |
| ME3691-5 | Glove box | 33.1 | 26.0 | 21.45 | |
| ME3689-5 | Glove box* | 33.1 | 19.5 | 41.24 | |
| ME3683-5 | Glove box | 31.2 | 31.1 | 0.16 | |
| ME3703-4 | Glove box | 28.9 | 24.7 | 14.53 | |
| ME3707-5 | Glove box | 27.8 | 21.7 | 21.94 | |
| ME3737-5 | Glove box* | 25.7 | 13.5 | 47.67 | |

Glove box. These splits from TABLE I were stored in the glove box under nitrogen atmosphere for the total amount of time that other splits from the same sample were being stored, handled and tested.

TABLE II

| Split | | Residual Oxygen Demand Average (torr/g, 2500 minutes) | | Change (% of pre-test | Graphing |
|---|---|---|---|---|---|
| Number | Treatment | Pre-test | Post-test | value) | Category |
| ME3681-3 | Atm 90 | 28.2 | 26.9 | 4.61 | None |
| ME3681-4 | Atm 180 | 28.2 | 27.6 | 2.13 | None |
| ME3690-1 | Atm 270* | 32.4 | 22.5 | 30.56 | B |
| ME3691-1 | Atm 270 | 33.1 | 23.7 | 28.40 | |
| ME3684-1 | Atm 270 | 30.5 | 27.9 | 8.63 | |
| ME3683-1 | Atm 270 | 31.2 | 28.6 | 8.35 | |
| ME3689-1 | Atm 270* | 33.1 | 15.0 | 54.68 | |
| ME3681-2 | Atm 270 | 28.2 | 27.4 | 3.01 | |
| ME3681-1 | Atm 270 | 28.2 | 22.4 | 20.69 | |
| ME3682-1 | Atm 270 | 28.2 | 24.0 | 14.89 | |
| ME3692-1 | Atm 270 | 30.7 | 25.3 | 17.75 | |

Atm X. These splits were exposed to atmospheric-pressure dry air flowing slowly over the split for a total of the specified number of minutes.

TABLE III

| Split Number | Treatment | Residual Oxygen Demand Average (torr/g, 2500 minutes) Pre-test | Post-test | Change (% of pre-test value) | Graphing Category |
|---|---|---|---|---|---|
| ME3683-3 | Step 0/70/0 | 31.2 | 22.3 | 28.41 | None |
| ME3683-4 | Step 7/7/70 | 31.2 | 24.4 | 21.67 | None |
| ME3683-2 | Step 70/0/0 | 31.2 | 25.0 | 19.74 | None |
| ME3682-5 | Step 70/70/70 | 28.2 | 18.3 | 35.02 | C |
| ME3682-4 | Step 70/70/70 | 28.2 | 19.4 | 31.38 | |
| ME3736-1 | Step 70/70/70 | 31.4 | 11.6 | 63.22 | |

Step X/Y/Z. These splits for TABLE III were exposed to pressurized dry air at 500 psi for X minutes, then pressurized to 1000 psi for Y minutes, and finally, pressurized to 1500 psi for Z minutes before reducing the pressure to atmospheric.

TABLE IV

| Split Number | Treatment | Residual Oxygen Demand Average (torr/g, 2500 minutes) Pre-test | Post-test | Change (% of pre-test value) | Graphing Category |
|---|---|---|---|---|---|
| ME3684-4 | Cyc 0/10/0 | 30.5 | 24.1 | 20.98 | None |
| ME3684-5 | Cyc 1/1/10 | 30.5 | 22.3 | 27.05 | None |
| ME3684-2 | Cyc 10/0/0 | 30.5 | 23.5 | 22.95 | None |
| ME3702-4 | Cyc 10/10/10 | 26.0 | 13.1 | 49.62 | D |
| ME3682-3 | Cyc 10/10/10 | 28.2 | 18.1 | 35.99 | |
| ME3692-2 | Cyc 10/10/10 | 30.7 | 16.4 | 46.74 | |
| ME3691-2 | Cyc 10/10/10 | 33.1 | 14.4 | 56.65 | |
| ME3682-2 | Cyc 10/10/10 | 28.2 | 18.8 | 33.33 | |
| ME3684-3 | Cyc 10/10/10 | 30.5 | 21.7 | 29.02 | |

Cyc X/Y/Z. These splits were cycled between atmospheric pressure and the higher pressure, first X times to 500 psi for 7 minutes, then Y times to 1000 psi for 7 minutes, and finally Z times to 1500 psi for seven minutes using dry air. The time at atmospheric pressure was 2 minutes for each cycle (See FIG. 2).

TABLE V

| Split Number | Treatment | Residual Oxygen Demand Average (torr/g, 2500 minutes) Pre-test | Post-test | Change (% of pre-test value) | Graphing Category |
|---|---|---|---|---|---|
| ME3689-2 | Vac cyc 10/0/0 | 33.1 | 15.1 | 54.38 | None |
| ME3690-2 | Vac cyc 10/10/10* | 32.4 | 14.0 | 56.79 | E |
| ME3689-4 | Vac cyc 10/10/10* | 33.1 | 14.3 | 56.80 | |
| ME3689-3 | Vac cyc 10/10/10* | 33.1 | 16.5 | 50.30 | |
| ME3692-4 | Vac cyc 10/10/10 | 30.7 | 15.4 | 50.00 | |
| ME3691-4 | Vac cyc 10/10/10 | 33.1 | 15.2 | 54.23 | |
| ME3690-5 | Vac cyc 10/10/10* | 32.4 | 12.4 | 61.73 | |
| ME3706-5 | Vac cyc 10/10/10 | 29.4 | 15.0 | 49.15 | |
| ME3736-5 | Vac cyc 10/10/10 | 31.4 | 13.4 | 57.48 | |

Vac cyc X/Y/Z. These splits for TABLE V were cycled between a vacuum and the higher pressure, first X times to 500 psi for 7 minutes, then Y times to 1000 psi for 7 minutes, and finally Z times to 1500 psi for seven minutes using dry air. The time under vacuum totaled 2.5 minutes for each cycle.

TABLE VI

| Split Number | Treatment | Residual Oxygen Demand Average (torr/g, 2500 minutes) Pre-test | Post-test | Change (% of pre-test value) | Graphing Category |
|---|---|---|---|---|---|
| ME3692-3 | Wet cyc 10/10/10 | 30.7 | 14.8 | 51.79 | F |
| ME3691-3 | Wet cyc 10/10/10 | 33.1 | 14.7 | 55.59 | |
| ME3690-3 | Wet cyc 10/10/10* | 32.4 | 12.8 | 60.49 | |
| ME3690-4 | Wet cyc 10/10/10* | 32.4 | 12.7 | 60.80 | |
| ME3706-3 | Wet cyc 10/10/10 | 29.4 | 10.4 | 64.80 | |
| ME3737-3 | Wet cyc 10/10/10* | 25.7 | 7.0 | 72.96 | |

Wet cyc X/Y/Z. These splits for TABLE VI were cycled between atmospheric pressure and the higher pressure, first X times to 500 psi for 7 minutes, then Y times to 1000 psi for 7 minutes, and finally Z times to 1500 psi for seven minutes using humid air. The time at atmospheric pressure was 2 minutes for each cycle.

TABLE VII

| Split Number | Treatment | Residual Oxygen Demand Average (torr/g, 2500 minutes) Pre-test | Post-test | Change (% of pre-test value) | Graphing Category |
|---|---|---|---|---|---|
| ME3703-1 | Vac cyc 1/1/40 | 28.9 | 14.8 | 48.79 | G |
| ME3707-1 | Vac cyc 1/1/40 | 27.8 | 9.8 | 64.93 | |
| ME3702-1 | Vac cyc 1/1/40 | 26.0 | 12.0 | 53.85 | |
| ME3706-1 | Vac cyc 1/1/40 | 29.4 | 11.0 | 62.76 | |
| ME3737-1 | Vac cyc 1/1/40* | 25.7 | 8.0 | 69.07 | |

Vac cyc X/Y/Z. These splits for TABLE VII were cycled between a vacuum and the higher pressure, first X times to 500 psi for 7 minutes, then Y times to 1000 psi for 7 minutes, and finally Z times to 1500 psi for seven minutes using dry air. The time under vacuum totaled 2.5 minutes for each cycle.

TABLE VIII

| Split Number | Treatment | Residual Oxygen Demand Average (torr/g, 2500 minutes) Pre-test | Post-test | Change (% of pre-test value) | Graphing Category |
|---|---|---|---|---|---|
| ME3707-2 | Wet cyc-vac 10/10/10 | 27.8 | 9.2 | 66.91 | H |
| ME3703-2 | Wet cyc-vac 10/10/10 | 28.9 | 14.4 | 50.17 | |
| ME3706-2 | Wet cyc-vac 10/10/10* | 29.4 | 12.2 | 58.39 | |
| ME3702-2 | Wet cyc-vac 10/10/10 | 26.0 | 11.8 | 54.81 | |
| ME3736-3 | Wet cyc-vac 10/10/10 | 31.4 | 13.5 | 57.01 | |

Wet cyc-vac X/Y/Z. These splits for TABLE VIII were cycled between a vacuum and the higher pressure, first X times to 500 psi for 7 minutes, then Y times to 1000 psi for 7 minutes, and finally Z times to 1500 psi for seven minutes using humid air. The time at the low vacuum totaled 2.5 minutes for each cycle.

TABLE IX

| Split Number | Treatment | Residual Oxygen Demand Average (torr/g, 2500 minutes) Pre-test | Post-test | Change (% of pre-test value) | Graphing Category |
|---|---|---|---|---|---|
| ME3702-3 | Fast wet cyc-vac 90/0/0 | 26.0 | 14.1 | 45.77 | I |
| ME3703-3 | Fast wet cyc-vac 90/0/0 | 28.9 | 18.1 | 37.37 | |

Fast wet cyc vac X/Y/Z. These splits were cycled similarly to the Vac cyc X/Y/Z samples (See Table V), except that humid air was used as the treating gas, and the times at high pressure and vacuum were reduced to 1 minute each.

TABLE X

| Split Number | Treatment | Residual Oxygen Demand Average (torr/g, 2500 minutes) Pre-test | Post-test | Change (% of pre-test value) | Graphing Category |
|---|---|---|---|---|---|
| ME3706-4 | Wet cyc-vac 1/1/40 | 29.4 | 9.5 | 67.86 | J |
| ME3736-4 | Wet cyc-vac 1/1/40 | 31.4 | 10.3 | 67.36 | |
| ME3737-4 | Wet cyc-vac 1/1/40* | 25.7 | 6.3 | 75.68 | |

Wet cyc-vac X/Y/Z. These splits for TABLE X were cycled between a vacuum and the higher pressure, first X times to 500 psi for 7 minutes, then Y times to 1000 psi for 7 minutes, and finally Z times to 1500 psi for seven minutes using humid air. The time under vacuum totaled 2.5 minutes for each cycle.

TABLE XI

| Split Number | Treatment | Residual Oxygen Demand Average (torr/g, 2500 minutes) Pre-test | Post-test | Change (% of pre-test value) | Graphing Category |
|---|---|---|---|---|---|
| ME3692-5 | Moist atm 270 | 30.7 | 22.8 | 25.90 | None |

Moist atm X. These splits from TABLE XI were exposed to atmospheric-pressure humid air flowing slowly over the split for X minutes.

TABLE XII

| Split Number | Treatment | Residual Oxygen Demand Average (torr/g, 2500 minutes) Pre-test | Post-test | Change (% of pre-test value) | Graphing Category |
|---|---|---|---|---|---|
| ME3736-2 | Cyc-vac (30%) 1/1/10 + 30 | 31.4 | 11.4 | 63.85 | None |
| ME3737-2 | Cyc-vac (30%) 1/1/10 + 30* | 25.7 | 6.9 | 73.15 | None |

Cyc-vac (30%) X/Y/Z + AA. These splits for TABLE XII were cycled between a vacuum and the higher pressure, first X times to 500 psi for 7 minutes, then Y times to 1000 psi for 7 minutes, then Z times to 1500 psi for seven minutes using dry air, and finally, AA times to 1500 psi using a dry gas composed of 30% oxygen and 70% nitrogen. Tbe time under vacuum totaled 2.5 minutes for each cycle.
*Rows with this designation are tests and data that are deemed unreliable due to contamination by air during transport or storage.

Figure 6:
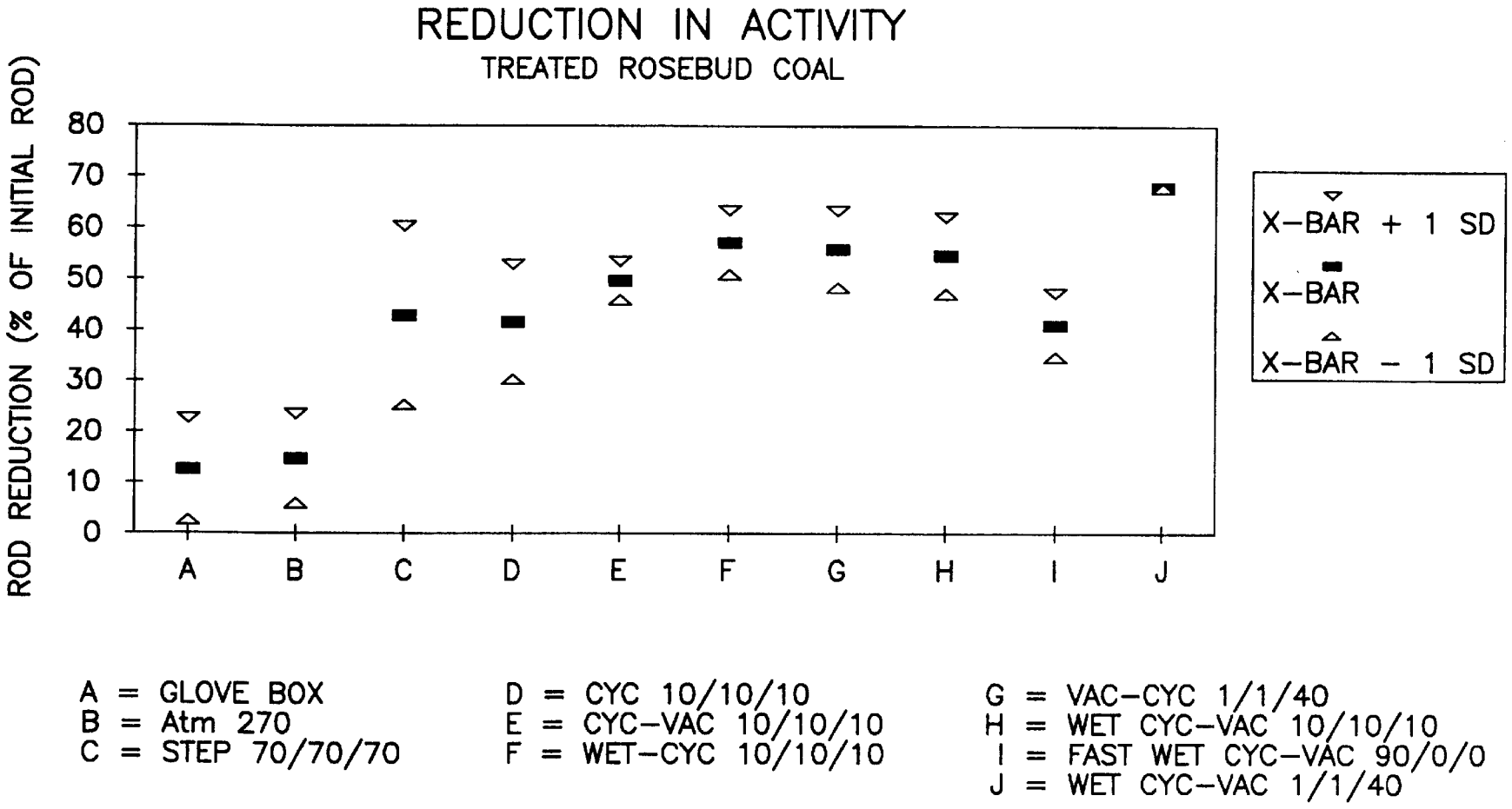
FIG. 6 is a graph of the Percent Reduction of Activity (ROD) for a number of embodiments of this invention.

FIG. 6 illustrates the Residual Oxygen Demand for each of the graphing categories. In all pressure treatment presented the oxygen demand of the coal was significantly reduced in the process.

It should be clear to those skilled in the art that there are many possible variations and combinations of these examples and that this process can be used on many materials for treatment of many different properties. One important aspect of this invention is the use of the pressure to force the oxygenated fluid into intimate contact with an active material, increasing the partial pressure of oxygen and through accelerated reaction changing the activity of the material.

Thus, in accordance with the invention, there has been provided a process to reduce the ability of carbonaceous material such as low-rank coal, dried coal, char or peat to spontaneously combust thereby rendering such carbonaceous materials amenable to normal transport and handling procedures. There has also been provided a means for stabilizing low-rank coals to improve the safety and economics for using such coals.

With this description of the invention in detail, those skilled in the art will appreciate that modification may be made to the invention without departing from the spirit thereof. Therefore, it is not intended that the scope of the invention be limited to the specific embodiments that have been illustrated and described. Rather, it is intended that the scope to the invention be determined by the scope of the appended claims.

We claim:

1. A process for the deactivation of a porous carbonaceous material comprising; providing an oxygenated gas; increasing the pressure of the oxygenated gas on the carbonaceous material from a first pressure to a second pressure; and reducing the pressure to a third pressure, wherein the third pressure is less than the second pressure.

2. The process of claim 1 for deactivation of a porous carbonaceous material comprising exposing the porous carbonaceous material to a gas at a first pressure;

providing an oxygenated gas;

increasing the pressure of the oxygenated gas on the porous carbonaceous material to a second pressure, wherein the second pressure is greater than the first pressure;

maintaining the pressure on the porous carbonaceous material for a period of time; and reducing the pressure of the oxygenated gas to a third pressure wherein the third pressure is less than the second pressure.

3. The process of claim 2 further comprising introducing the carbonaceous material to the oxygenated gas at a fourth pressure;

maintaining the pressure on the porous carbonaceous material for a period of time sufficient to oxygenate the carbonaceous material, wherein the fourth pressure is greater than the third pressure;

reducing the pressure of the oxygenated gas to a fifth pressure wherein the fifth pressure is less than the fourth pressure.

4. The process of claim 1 wherein the process takes place at a temperature from about −25° C. to about 750° C.

5. The process of claim 1 wherein the first pressure is less than atmospheric pressure.

6. The process of claim 1 wherein the second pressure is from about atmospheric pressure to about 2000 psig.

7. The process of claim 1 wherein the third pressure is from about atmospheric pressure to less than about 2000 psig.

8. The process of claim 3 wherein the fourth pressure is from about atmospheric pressure to about 2000 psig.

9. The process of claim 3 wherein the fifth pressure is from about atmospheric pressure to less than about 2000 psig.

10. The process of claim 3 wherein the fourth pressure is from about atmospheric pressure to about 1000 psig.

11. The process of claim 1 where the carbonaceous material is subbituminous coal or lignitic coal or char.

12. The process of claim 1 wherein the carbonaceous material contains from about 0.1 weight percent to about 15 weight percent of moisture.

13. The process of claim 1 wherein the oxygenated gas contains from about 1 volume percent to about 35 volume percent oxygen.

14. The process of claim 1 wherein the oxygenated gas contains from about 10 volume percent to about 25 volume percent oxygen.

15. The process of claim 1 wherein the oxygenated gas is air.

16. The process of claim 1 for deactivation of a porous carbonaceous material comprising exposing the porous carbonaceous material to a gas at a first pressure;

providing an oxygenated gas;

increasing the pressure of the oxygenated gas on the porous carbonaceous material to a second pressure, wherein the second pressure is greater than the first pressure;

maintaining the pressure on the porous carbonaceous material for a period of time;

increasing the pressure of the oxygenated gas to a third pressure wherein the third pressure is greater than the second pressure; and reducing the pressure of the oxygenated gas to a final pressure.

17. The process of claim 16 further comprising increasing the pressure of the oxygenated gas from the third pressure to a fourth pressure;

maintaining the pressure on the porous carbonaceous material at the fourth pressure for a period of time prior to reducing the pressure of the oxygenated gas.

18. A deactivated porous carbonaceous material formed by exposing the carbonaceous material to an oxygenated gas; increasing the pressure on the carbonaceous material from a first pressure to a second pressure; and reducing the pressure to a third pressure, wherein the third pressure is less than the second pressure.

19. The deactivated porous carbonaceous material of claim 18 wherein the porous carbonaceous material is exposed to an oxygenated gas at a first pressure;

increasing the pressure of the oxygenated gas on the porous carbonaceous material to a second pressure, wherein the second pressure is greater than the first pressure;

maintaining the pressure on the porous carbonaceous material for a period of time; and reducing the pressure of the oxygenated gas to a third pressure wherein the third pressure is less than the second pressure.

* * * * *